US011497985B2

(12) United States Patent
Szabolcs

(10) Patent No.: US 11,497,985 B2
(45) Date of Patent: Nov. 15, 2022

(54) 3-DIMENSIONAL LOGIC GAME

(71) Applicant: János Szabolcs, Budapest (HU)

(72) Inventor: János Szabolcs, Budapest (HU)

(73) Assignee: Janos Szabolcs, Budapest (HU)

( * ) Notice: Subject to any disclaimer, the term of this patent is extended or adjusted under 35 U.S.C. 154(b) by 32 days.

(21) Appl. No.: 17/262,322

(22) PCT Filed: Jul. 22, 2019

(86) PCT No.: PCT/HU2019/050036
§ 371 (c)(1),
(2) Date: Jan. 22, 2021

(87) PCT Pub. No.: WO2020/021296
PCT Pub. Date: Jan. 30, 2020

(65) Prior Publication Data

US 2021/0339118 A1 Nov. 4, 2021

(30) Foreign Application Priority Data

Jul. 23, 2018 (HU) ..... P1800259

(51) Int. Cl.
*A63F 9/08* (2006.01)
*A63F 9/34* (2006.01)

(52) U.S. Cl.
CPC ..... *A63F 9/0842* (2013.01); *A63F 9/0861* (2013.01); *A63F 9/34* (2013.01); *A63F 2009/0846* (2013.01); *A63F 2250/60* (2013.01)

(58) Field of Classification Search
CPC ..... A63F 9/34; A63F 9/0861; A63F 9/0838; A63F 9/0842; A63F 9/0869; A63B 2009/0846; A63B 2250/60
See application file for complete search history.

(56) References Cited

U.S. PATENT DOCUMENTS 4,529,201 A * 7/1985 Nadel ..... A63F 9/0838 273/153 S
9,409,080 B1 * 8/2016 Yang ..... A63F 9/083
2005/0098947 A1 * 5/2005 Hoberman ..... A63F 9/0869 273/153 R (Continued)

FOREIGN PATENT DOCUMENTS

DE 19849279 A1 * 4/2000 ..... A63F 9/0838
WO WO-9630098 A1 * 10/1996 ..... A63F 9/083

*Primary Examiner* — Steven B Wong
(74) *Attorney, Agent, or Firm* — Olson & Cepuritis, Ltd.

(57) ABSTRACT

A 3-dimensional logic game has a support structure, an actuating structure attached to the support structure and game elements attached to the actuating structure. The game elements are formed as carriages provided with first and second marking surfaces and are slidably mounted on rails attached to the actuating structure. The actuating structure is movable between a first and a second rest position. In the first rest position, a first group of three rails form first rail rings around vertices of a first tetrahedron wherein the first marking surfaces of the carriages are facing outwardly, while the second marking surfaces are facing inwardly. In the second rest position, a second group of three rails form second rail rings around vertices of a second tetrahedron while in the point reflection of the first tetrahedron reflected over the geometric centre thereof.

14 Claims, 12 Drawing Sheets

(56) References Cited

U.S. PATENT DOCUMENTS

| | | | | |
|---|---|---|---|---|
| 2008/0230988 | A1* | 9/2008 | Paquette | A63F 9/0838<br>273/153 R |
| 2010/0244377 | A1* | 9/2010 | Gao | A63F 9/0865<br>273/156 |

* cited by examiner

3-DIMENSIONAL LOGIC GAME

CROSS-REFERENCE TO RELATED APPLICATIONS

This application is a U.S. National Stage of PCT/HU2019/050036, filed Jul. 22, 2019, which claims priority of Hungarian Patent Application No. P1800259, filed Jul. 23, 2018, each of which is incorporated herein by reference.

The invention relates to a 3-dimensional logic game comprising a support structure, an actuating structure attached to the support structure and game elements attached to the actuating structure.

3-dimensional logic games are very popular up to the present day. One of the most well known such game is the Rubik cube which was patented in Hungary under No. 170062. The six sides of the Rubik cube are made up of the faces of smaller cubes, which are provided with different markings on each visible face. The smaller cubes can be rotated with respect to each other whereby the uniform markings on one side of the Rubik cube can be mixed with the different markings on the other sides and the puzzle can be solved by rearranging the uniform markings. These kind of 3-dimensional logic puzzle games help to enhance geometric perception and combinative skills. There exists a need for 3-dimensional logic games of similar concept but allowing different spatial moves.

Further details of the invention will be apparent from the accompanying figures and exemplary embodiments, wherein FIG. 1 is a perspective view of a first embodiment of a 3-dimensional logic game according to the invention in its first rest position.

The perspective views depicted in FIGS. 1-5 show a first embodiment of a 3-dimensional logic game 10 according to the invention in a first rest position of the game 10.

Figure 1:
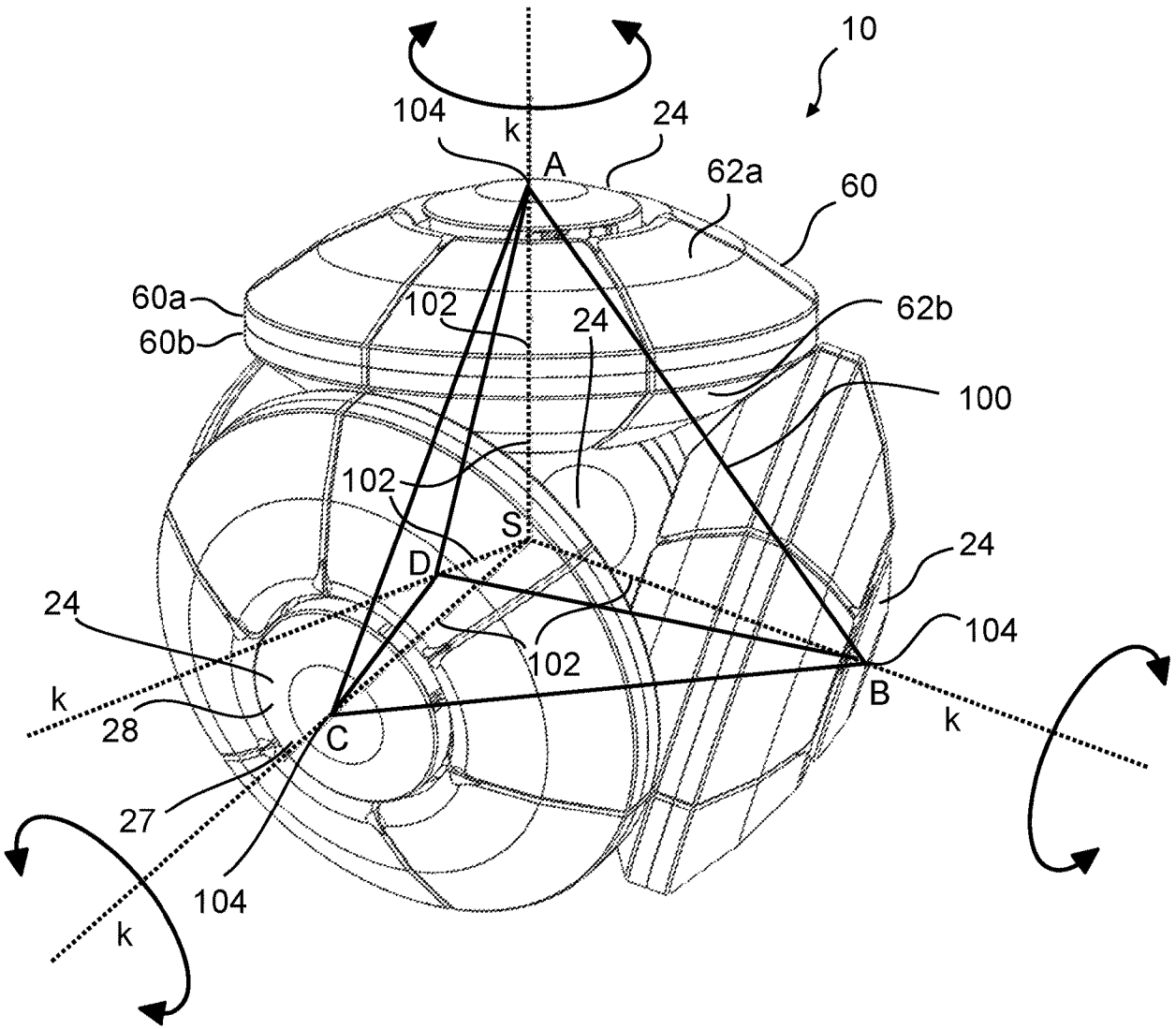
Figure 2:
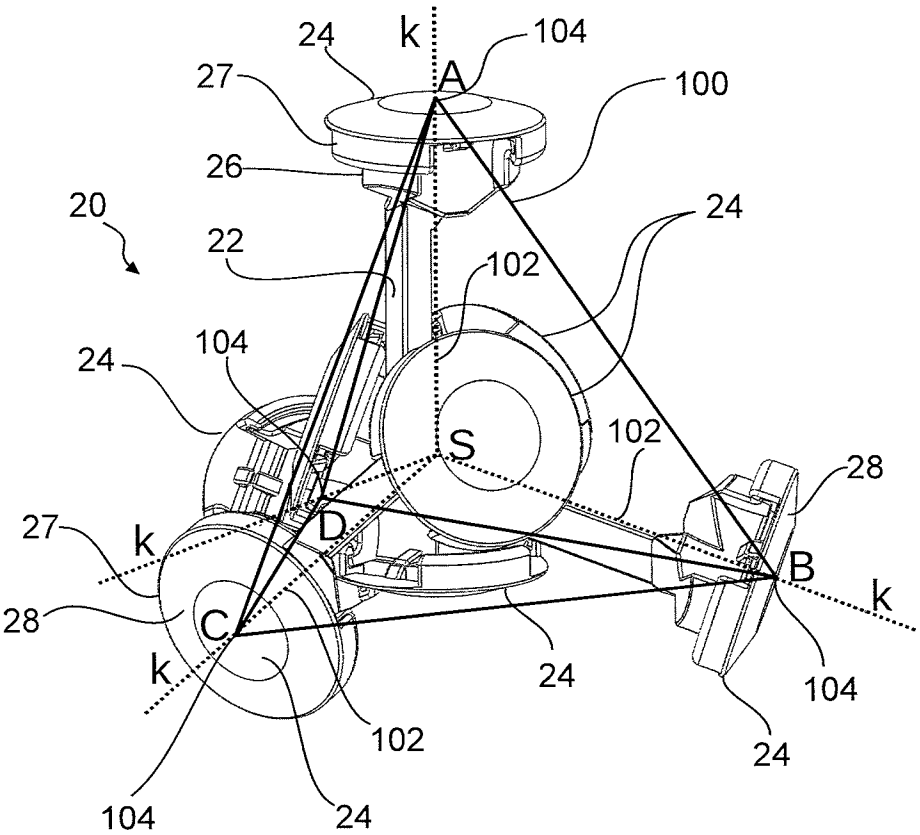
FIG. 2 is a perspective view of a support structure of the 3-dimensional logic game according to FIG. 1 in its first rest position.
Figure 3:
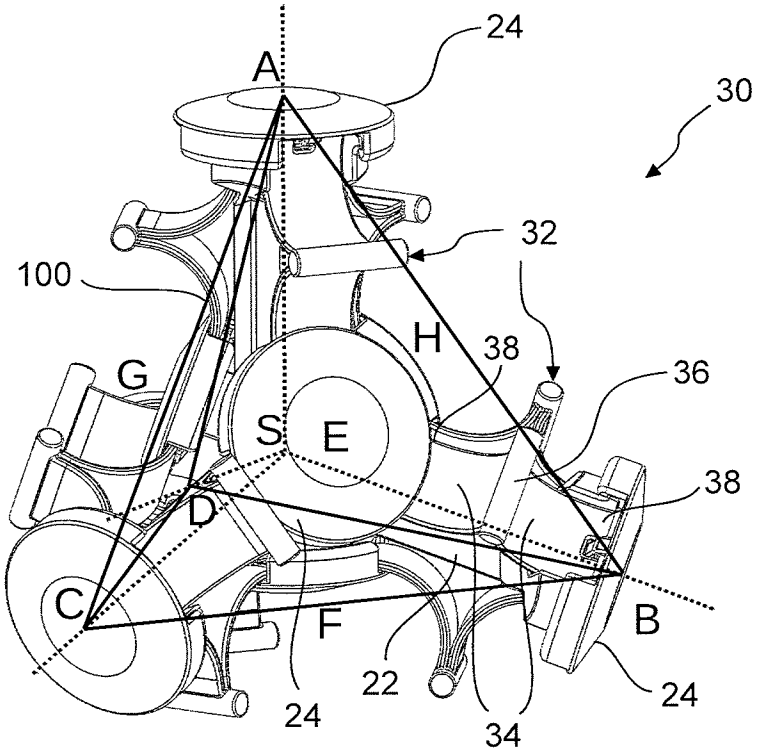
FIG. 3 is a perspective view of the support structure and of an interconnected actuating structure of the 3-dimensional logic game according to FIG. 1 in the first rest position.
Figure 4:
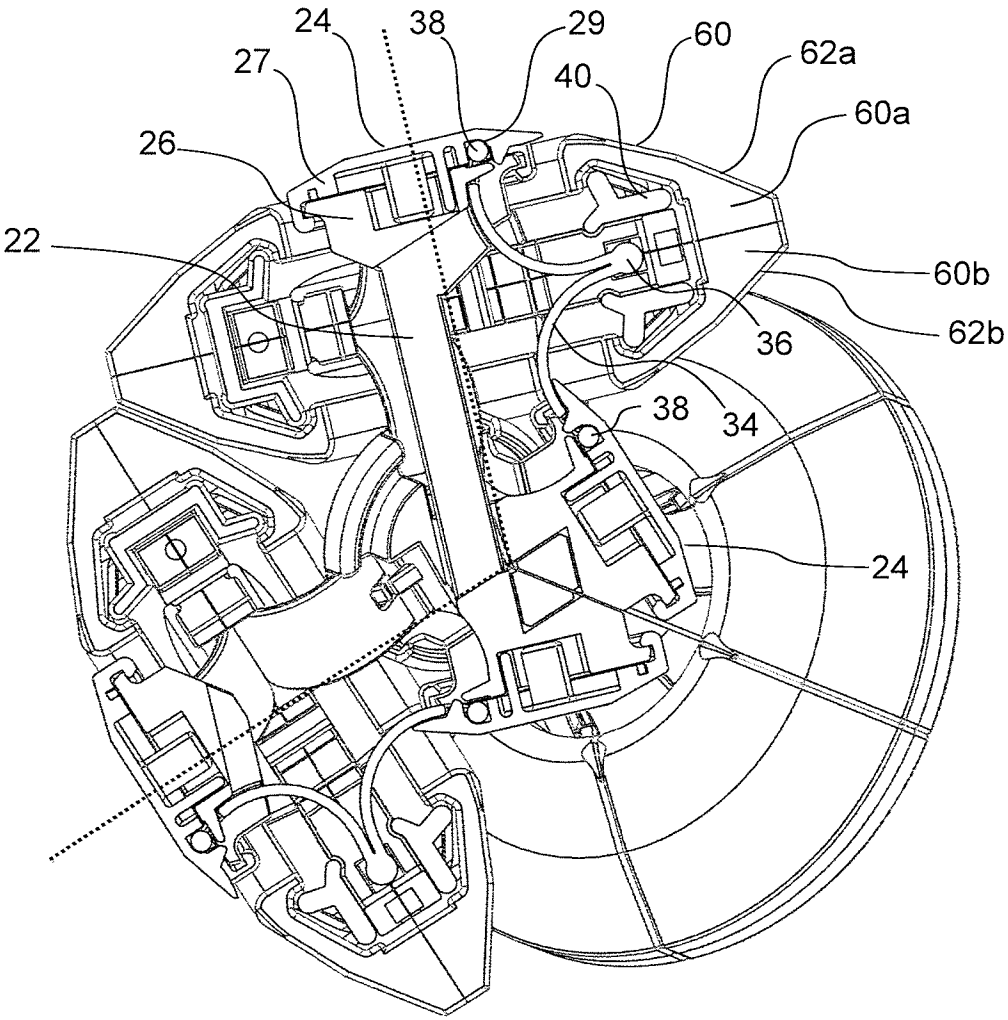
FIG. 4 is a view of the 3-dimensional logic game according to FIG. 1 cut in half.
Figure 5:
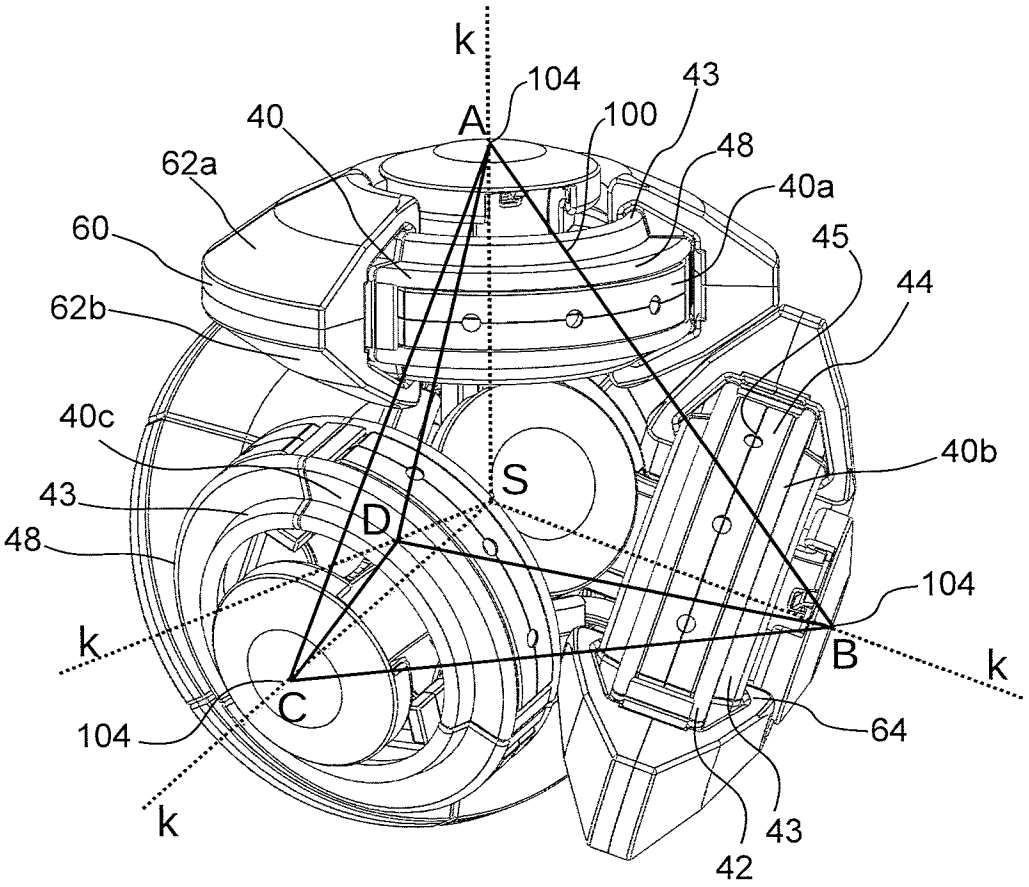
FIG. 5 is a perspective view of the 3-dimensional logic game according to FIG. 1 with partially removed carriages in the first rest position.

The 3-dimensional logic game 10 comprises a support structure 20 (FIG. 2), an actuating structure 30 connected to the support structure 20 (FIG. 3). Arc shaped rails 40 are attached to the actuating structure 30 and carriages 60 are mounted slidable on the rails 40 (FIGS. 4 and 5).

According to the present embodiment the support structure 20 comprises pushing bars 22 having skew axis with respect to each other. Each pushing bar 22 is provided with a pushing head 24 at each one of its two ends. The pushing bars 22 span a regular tetrahedron 100 such that the pushing bars 22 lie along medians 102 of the tetrahedron 100 and the pushing heads 24 at one end of each pushing bar 22 define the vertices 104 of the tetrahedron 100 while the pushing heads 24 on the other end of each pushing bar 22 are located inside the tetrahedron 100 (or lie closer to the interior of the tetrahedron 100). The median 102 of the tetrahedron 100 is a line that connects one vertex 104 of the tetrahedron with the geometric centre of the opposing side of the tetrahedron 100. The geometric centre of the triangle forming the side of the tetrahedron 100 is the intersection of the three lines connecting the three vertices of the triangle with the centre of the opposing sides. The medians 102 of the tetrahedron 100 also intersect in a single point which is the geometric centre S of the tetrahedron 100.

Tetrahedrons 100 of varying edge lengths may be drawn around the pushing bars 22 depending on the distance of the vertices 104 of the tetrahedron 100 from the pushing heads 24 lying further away from the geometric centre S. This has no importance from the point of view of the invention, the tetrahedron 100 being only an auxiliary object which helps to describe the two rest positions of the game 10. In the following disclosure the tetrahedron 100 defined by the pushing heads 24 lying further away from the geometric centre S is understood to be the smallest regular tetrahedron the medians 102 of which are each parallel with one of the pushing bars 22 and the vertices 104 of which touch the external surface of the pushing heads 24. The separate vertices 104 of the tetrahedron 100 are designated by the letters A, B, C, D.

According to the present embodiment each pushing head 24 comprises at least two parts: a body 26, which is formed integrally with the corresponding pushing bar 22, and cap 27 which is either attached to the body 26 permanently (e.g. by an adhesive) or disconnectably (e.g. by snap connections). The external surface of the pushing head 24 may be formed as a marking surface 28 for increasing the number of combinations achievable by the 3-dimensional logic game 10. The marking surface 28 may be provided with markings in any known way, e.g. by printing, by painting, by using stickers, by colouring the material of the marking surface 28 or by modifying the surface structure (e.g. with embossment or by forming recesses therein). The embossed marking, recessed markings or other similar palpable markings allow blind or visually impaired people to recognise and differentiate between the markings. According to a particularly preferred embodiment the pushing head 24 comprise caps 27 made of coloured material whereby the marking on the marking surface 28 may be the colour of the material.

According to the present embodiment the actuating structure 30 comprises double-armed actuating elements 32 the arms 34 of which are connected to each other at one of their ends by a linking element 36, while their other ends (free ends 38) are connected are connected to a pair of neighbouring pushing bars 22 in the vicinity of their pushing heads 24 that lie closer to each other (see FIG. 3). The vicinity of the pushing head 24 is understood to mean the third of the pushing bar 22 which is closest to the given pushing head 24, including the possibility that the free ends 38 are connected to the pushing bar 22 through the pushing head 24, for example as can be seen in FIG. 4 wherein the free ends 38 are inserted in a nest 29 formed between the body 26 of the pushing head 24 and the cap 27.

FIG. 4 also shows that a rail 40 is connected to each linking element 36 of the actuating elements 32 such as to hold the rail 40 in a fixed position with respect to the linking element 36. For example, a groove may be formed inside the rail 40 and the linking element 36 may be snapped into this groove. It should be appreciated that the connection can be ensured by other type of releasable or non-releasable connections (e.g. gluing), furthermore, the rail 40 and the linking element 36 may be formed integrally, optionally together with the whole of the actuating element 32.

According to the present embodiment the two arms 34 of each actuating element 32 is formed of a resilient material in order to be able to flex with respect to the linking element 36 linking them by way or elastic deformation, whereby the two free ends 38 of the two arms 34 can approach each other and move away from each other, which allows for sliding the two pushing bars 22, which are connected by the given actuating element 32, with respect to each other as will be explained in more detail later on.

Moving the pushing bars 22 with respect to each other can be achieved in other ways as well, for example the double-armed actuating elements 32 may have rigid arms 34 which are connected by a linking element 36 formed as a hinge or comprising a hinge whereby the two arms 34 can be rotated with respect to each other and the angle formed by the two arms 34 may vary respectively, which allows for pushing the interconnected pushing bars 22 along their own axis.

Figure 6:
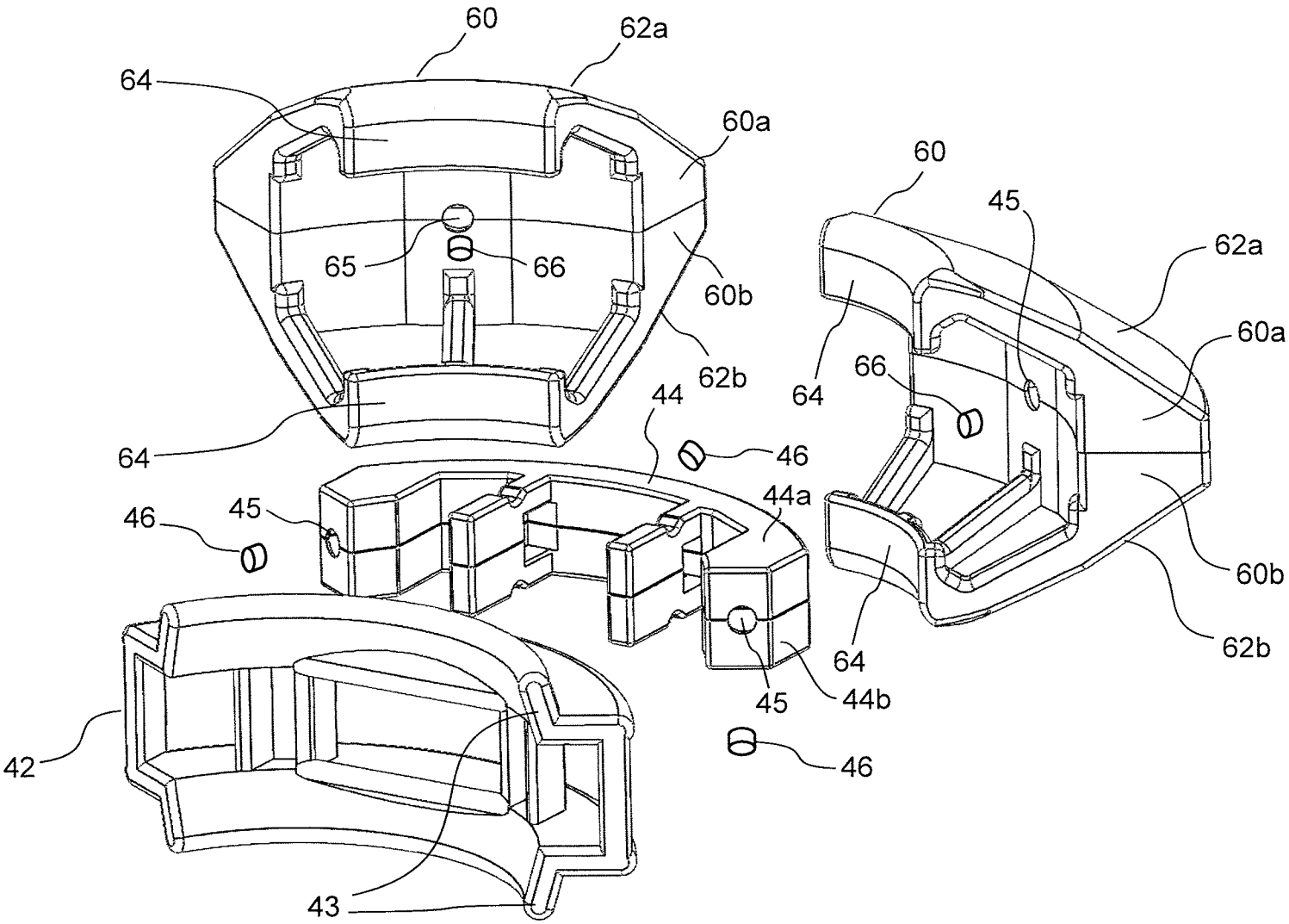
FIG. 6 is an exploded perspective view of one rail and two carriages arranged thereon of the 3-dimensional logic game according to FIG. 1

The carriages 60 are provided with a first marking surface 62*a* and a second marking surface 62*b* on their two sides. The marking surfaces 62*a*, 62*b* may be provided with markings in any known way, e.g. by printing, by painting, by using stickers, by colouring the material of the marking surfaces 62*a*, 62*b* or by modifying the surface structure (e.g. with embossment or by forming recesses therein). According to a particularly preferred embodiment the carriages 60 are made up of two halves 60*a*, 60*b* (see FIG. 6) which are made of differently coloured material (e.g. plastic) in which case the marking on one side of the first half 60*a*, functioning as the marking surface 62*a*, is the colour of the first half 60*a*, and similarly, the marking on one side of the second half 60*b*, functioning as the marking surface 62*b*, is the colour of the second half 60*b*, which is preferably different from the colour of the first half 60*a*. The marking surface 62*a*, 62*b* may comprise embossed markings, recessed markings or other similar palpable markings for blind or visually impaired people.

The rails may consist of more than one piece as well. In the present case each rail 40 comprises a rail frame 42 and a rail insert 44. According to the present embodiment an upper and a lower flange 43 of the rail frame 42 serve to guide an inwardly inclined upper and lower hook edge 64 of the carriages 60, respectively, as can be perceived in FIG. 5 where some of the carriages 60 have been removed in order to render the connection visible. Some of the rails 40 in FIG. 5 are denoted with separate reference numerals 40*a*, 40*b*, 40*c*, these rails 40 do not differ from the other rails 40, the different denotation has been introduced in order to better describe the two rest positions of the actuating structure 30, which will be discussed in connection with FIG. 7.

Preferably nests 45 are formed inside the rail 40, in the present case inside the rail insert 44 wherein magnets 46 are arranged for positioning the carriages 60. Arranging the magnets 46 can be facilitated by forming the rail insert 44 from two halves 44*a*, 44*b* which may be attached to each other for example by way of a snap connection. Before the two halves 44*a*, 44*b* are snapped together the magnets 46 can be easily placed inside the nests 45 formed in one of the halves 44*a*, 44*b*, after which the other half 44*b*, 44*a* is placed thereon and the magnet 46 becomes trapped inside the nest 45. In order to achieve this the dimension of the openings of the nests 45 and the diameter of the magnets 46 are chosen such that the magnets 46 cannot pass through the openings of the nests 45 once the two halves 44*a*, 44*b* of the rail insert 44 are connected. It is also conceivable to form each rail 40 as a single element or to form them of different type of pieces in which case the magnets 46 (if any) are arranged in other ways (e.g. by fixing the magnets 46 on the external surface of the rails 40 using an adhesive). The multiple part design shown in FIG. 6 offers an advantageous way of arranging the magnets 46 inside the rails 40 from the point of view of manufacture.

Preferably the rails 40 are also provided with nests 45 and magnets 46 on their sides facing the neighbouring rails 40 (see FIGS. 5 and 6) for facilitating the creation of the rail rings 48 depicted in FIG. 5 by arranging the magnets 46 of the neighbouring rails 40 with opposed polarity (such as to attract each other). Accordingly, the magnet 46 arranged in the nest 45 formed in the side of one rail 40 has its north pole facing outwardly, while the magnet 46 arranged in the nest 45 formed in the side of a neighbouring rail 40 has its south pole facing outwardly, whereby the two magnets attract each other and help to keep the rail ring 48 together which facilitates sliding the carriages 60 from the one rail 40 to the neighbouring rail 40. Another possibility is to use a magnet 46 and a magnetisable material instead of two magnets 46 for the purpose of positioning. A magnetisable material is understood to be a material that is originally non-magnetic, however under the effect of an external magnetic field it becomes magnetic, whereby the magnet 46 can attract such materials. For example, ferromagnets and paramagnets are such magnetisable material. In this case one rail 40 is provided with the magnet 46 and the other rail 40, which is to be positioned with respect to the former one, is provided with a magnetisable material.

Positioning of the rails 40 and stabilising the rail ring 48 can be achieved in other ways as well, for example an embodiment is conceivable wherein the sides of the neighbouring rails are provided with projections and indentations together forming snap connections.

The carriages 60 are also provided with nests 65 at locations corresponding to the locations of the nests 45 formed in the rail inserts 44, wherein magnets 66 are arranged in a similar way and with a polarity opposing that of the magnets 46 of the rail inserts 44. This is understood to mean that the magnets 46 and 66 are arranged such as to attract each other when the carriage 60 that is displaceable along the rail 40 reaches a position where the magnet 66 arranged in the nest 65 of the carriage 60 approaches a magnet 46 arranged in one of the nests 45 of the rail insert 44, for example if the south pole of the magnet 46 is facing the opening of the nest 45 then the north pole of the magnet 66 is facing the opening of the nest 65. It is also conceivable to provide a magnet 46 or 66 and a magnetisable material instead of two magnets 46 and 66 for the purpose of positioning. In this case one of the elements is provided with the magnet 46 or 66 and the other element, which is to be positioned with respect to the former element, is provided with a magnetisable material.

The carriages 60 can also be made of one or more pieces and the skilled person is offered with a number of ways to fix the magnets 66, for example by gluing or by providing the openings of the nests 65 having greater diameters with rings for narrowing the openings and keeping the magnets 66 inside.

According to the present embodiment each rail 40 is provided with two carriages 60, however more or less carriages 60 could be arranged as well. Preferably the number of carriages 60 on a rail ring 48 is three or a multiple of three, particularly preferably three, six or nine carriages 60 are provided on each rail ring 48.

It can be seen in FIG. 5 that in the present case the rail inserts 44 comprise three nests 45 for accommodating magnets 46, which three nests 45 are facing the carriages 60. When two carriages 60 are entirely on the rail 40 than the two side nests 45 are each facing one of the nests 65 of the two carriages 60. The middle nest 45 of the rail insert 44 can be left empty or a third magnet 46 can be placed therein such that its polarity is the opposite of that of the other two magnets 46, i.e. with the same polarity as the polarity of the magnets 66 arranged in the carriages 60. This middle magnet 46 helps the carriages 60 to be moved to the two sides of the rail 40 and prevent them from stopping in a position where one of the carriages 60 is situated at the middle of the rail 40, while the other carriage 60 extends therefrom onto the neighbouring rail 40, in which position the game 10 could not be brought from one rest position to the other rest position as will be apparent from the following description.

A further embodiment is conceivable wherein the number of nests 45 formed on each rail 40 is in line with the number of carriages 60 that can be arranged on the given rail 40 such that each carriage 60 is held in position by one or more magnets 46 and 66.

Positioning of the carriages 60 can be achieved in other ways as well, for example an embodiment is conceivable wherein the rails 40 and the carriages 60 are provided with projections and indentations at corresponding location which together ensure snap connections.

The actuating structure 30 of the 3-dimensional logic game 10 can be moved between a first and a second rest position. The first rest position can be seen in FIGS. 1-3 and 5. In this position groups of three of the rails 40 form the first rail rings 48 around the vertices 104 of the first tetrahedron 100. The central axes k of each rail ring 48 coincides with the median 102 ending at the corresponding vertex 104 of the tetrahedron 100. The first marking surfaces 62*a* of the carriages 60 on the first rail rings 48 are facing outwardly, in a direction away from the geometric centre S of the first tetrahedron 100 while the second marking surfaces 62*b* are facing inwardly. The rails 40 forming the first ring rails 48 are connected to each other such as to allow sliding the carriages 60 on the neighbouring rails 40 within each rail rings 48. Accordingly, the carriages 60 can be slid around (rotated around) each rail ring 48 as illustrated by the arrows in FIG. 1.

The neighbouring rails 40 within a rail ring 48 are substantially continuous in the sense that there is no such gap, discontinuity or other obstacle that would hinder sliding the carriages 60 from one rail 40 to the other. This is further ensured by the side magnets 46 which help to better position and attach the rails 40.

Figure 7:
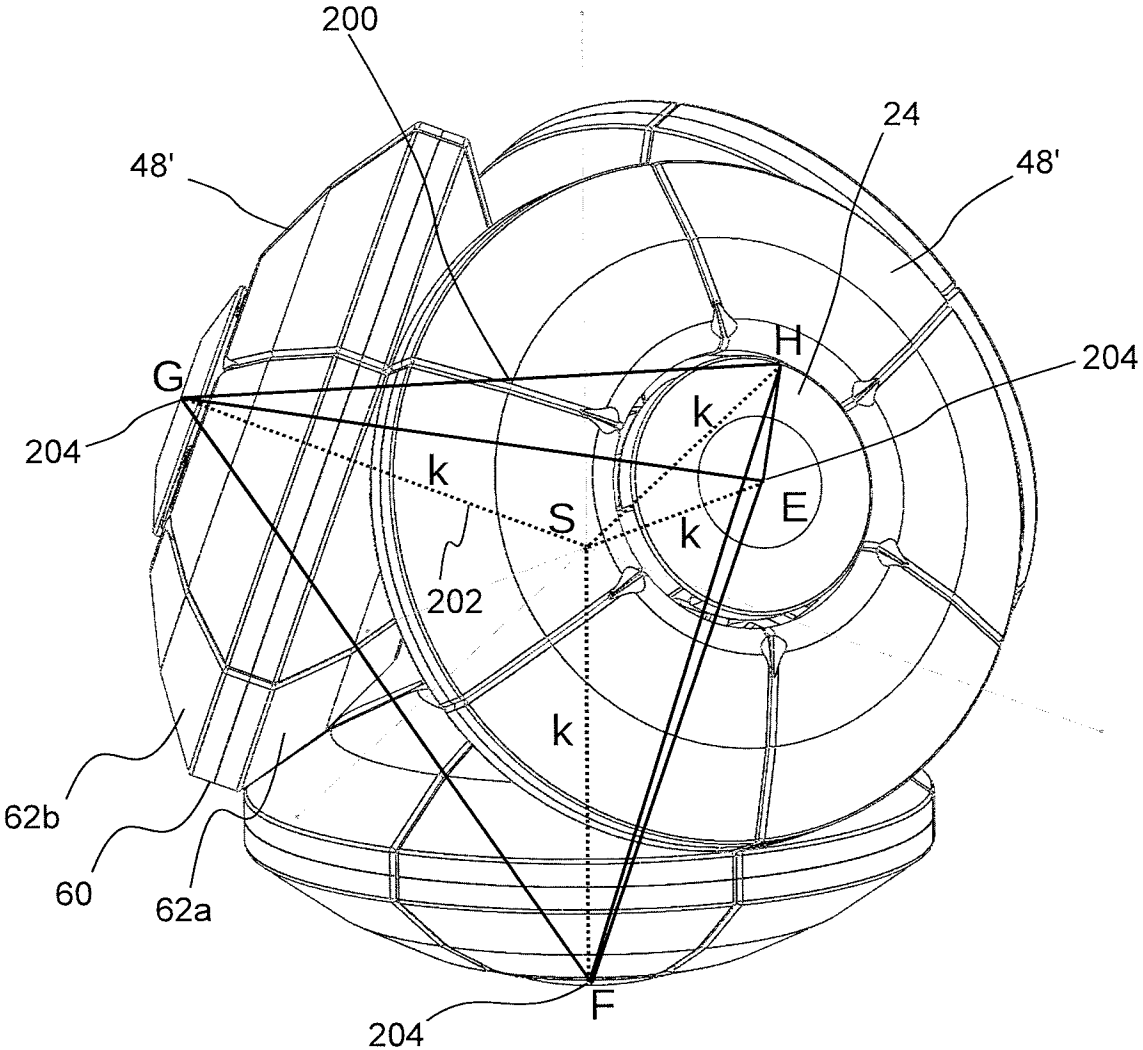
FIG. 7 is a perspective view of the 3-dimensional logic game according to FIG. 1 in its second rest position.
Figure 8:
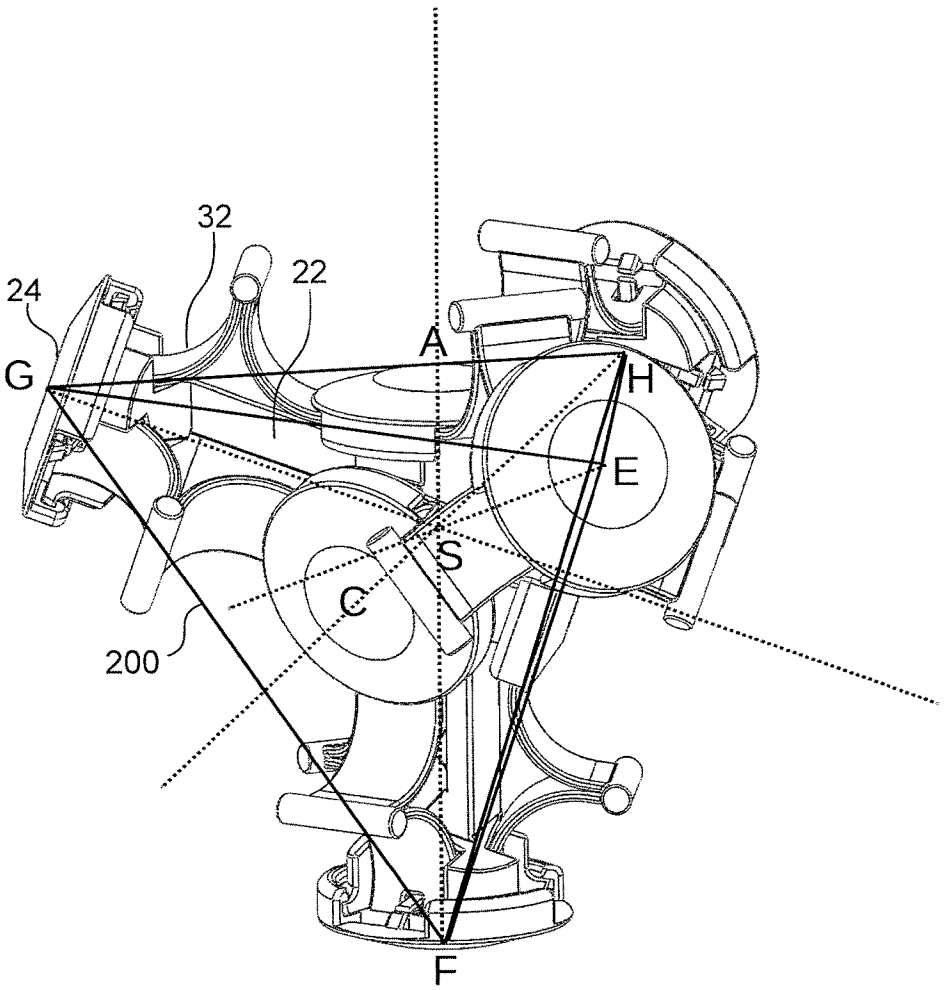
FIG. 8 is a perspective view of the support structure and of the interconnected actuating structure of the 3-dimensional logic game according to FIG. 1 in the second rest position.

In the second rest position of the actuating structure 30 the 3-dimensional logic game 10 assumes the geometry shown in FIG. 7 wherein the pushing bars 22 and pushing heads 24 define a second tetrahedron 200 having medians 202 terminating in vertices 204 and intersecting in a second geometric centre S' of the second tetrahedron 200. The axes of the pushing bars 22 in FIG. 7 have not changed, however, the pushing heads 24 of all four pushing bars 22 that were originally located at the vertices 104 of the first tetrahedron 100 have been displaced in the direction of the geometric centre S of the tetrahedron 100 as can be better seen in FIG. 8. In order to render the first rest position depicted in FIG. 3 and the second rest position depicted in FIG. 8 better comparable the vertices 104 and 204 of the first and second tetrahedron 100 and 200, respectively, have been denoted by the letters A, B, C, D, and E, F, G, H, respectively. Since the vertices 104, 204 are defined by the pushing heads 24, thus the letters of the vertices 104, 204 have also been indicated in the Figure wherein the pushing heads 24 define the other tetrahedron 100 or 200. In this way it can be traced back how each vertex 104, 204 (and the pushing head 24 defining the given vertex 104, 204) has been dislocated.

The second tetrahedron 200 is the point reflection of the first tetrahedron 100 reflected over the geometric centre S. Accordingly, second tetrahedron 200 can be obtained by reflecting each vertex 104 of the first tetrahedron 100 over the geometric centre S. This implies that the locations of the geometric centre S of the two tetrahedron 100, 200 remains unchanged, and the geometric centre S divides the pushing bars 22 in approximately 2:1 ratio but the pushing head 24 lying further away from the geometric centre S in the first tetrahedron 100 lies closer to the geometric centre S in the second tetrahedron 200.

In the second rest position of the actuating structure 30 groups of three of the rails 40 form the second rail rings 48' around the vertices 204 of the second tetrahedron 200 such that each rail 40 forms one of the second rail rings 48' around one of the vertices 204 of the second tetrahedron 200 together with the two rails 40 that are positioned closest to it around neighbouring vertices 104 of the first tetrahedron 100 in the first rest position. Accordingly, in FIG. 7 the rail ring 48' formed around the vertex 204 denoted by the letter E is made up of the rails 40*a*, 40*b*, 40*c* belonging to the rail rings 48 around the vertices 104 denoted by A, B, C, respectively, in FIG. 5.

The central axes k of the second rail rings 48' also coincide with the medians 202 of the second tetrahedron 200 starting from the corresponding vertices 204 since the pushing bars 22 are displaced along their own longitudinal axes and cannot rotate around their own axes.

On the second rail rings 48' the second marking surfaces 62*b* of the carriages 60 are facing outwardly, in a direction away from a geometric centre of the second tetrahedron 200 while the first marking surfaces 62*a* are facing inwardly, meaning that the rails 40 and the carriages 60 rotate while the actuating structure 30 is brought from the first rest position to the second rest position as will be explained in more detail later on.

The rails 40 of the second rail rings 48' are also connected to each other such as to allow the carriages 60 to be displaced to a neighbouring rail 40 within the same rail ring 48'.

It is to be noted that each rail 40 may also be made up of more than one separate rail piece, however in the context of the present invention all rail pieces are referred to as a single rail 40 which can be rotated from one given pushing head 24 to another given pushing head 24 in the first and second rest position of the actuating structure 30, respectively. For example in FIGS. 11, 12 the rail 40 between the pushing head 24 defining the vertex 104 denoted with the letter A and the pushing head 24 defining the vertex 204 denoted with the letter H is regarded as a single rail 40 even if it is made up of separate parts because functionally it acts as a single rail 40. The same terminology is applied for the given actuating element 32 (made up of one or more pieces) which actuates the rail 40, meaning that the actuating element 32 can also consist of more than one separate pieces. The actuating elements 32 are distinguished from each other based on between which two pushing heads 24 do they move the rail 40 interposed therebetween (which may consist of one or more pieces).

In the following it will be described how the actuating structure 30 moves the parts of the game 10 from their location in the first rest position to their location in the second rest position.

Figure 9:
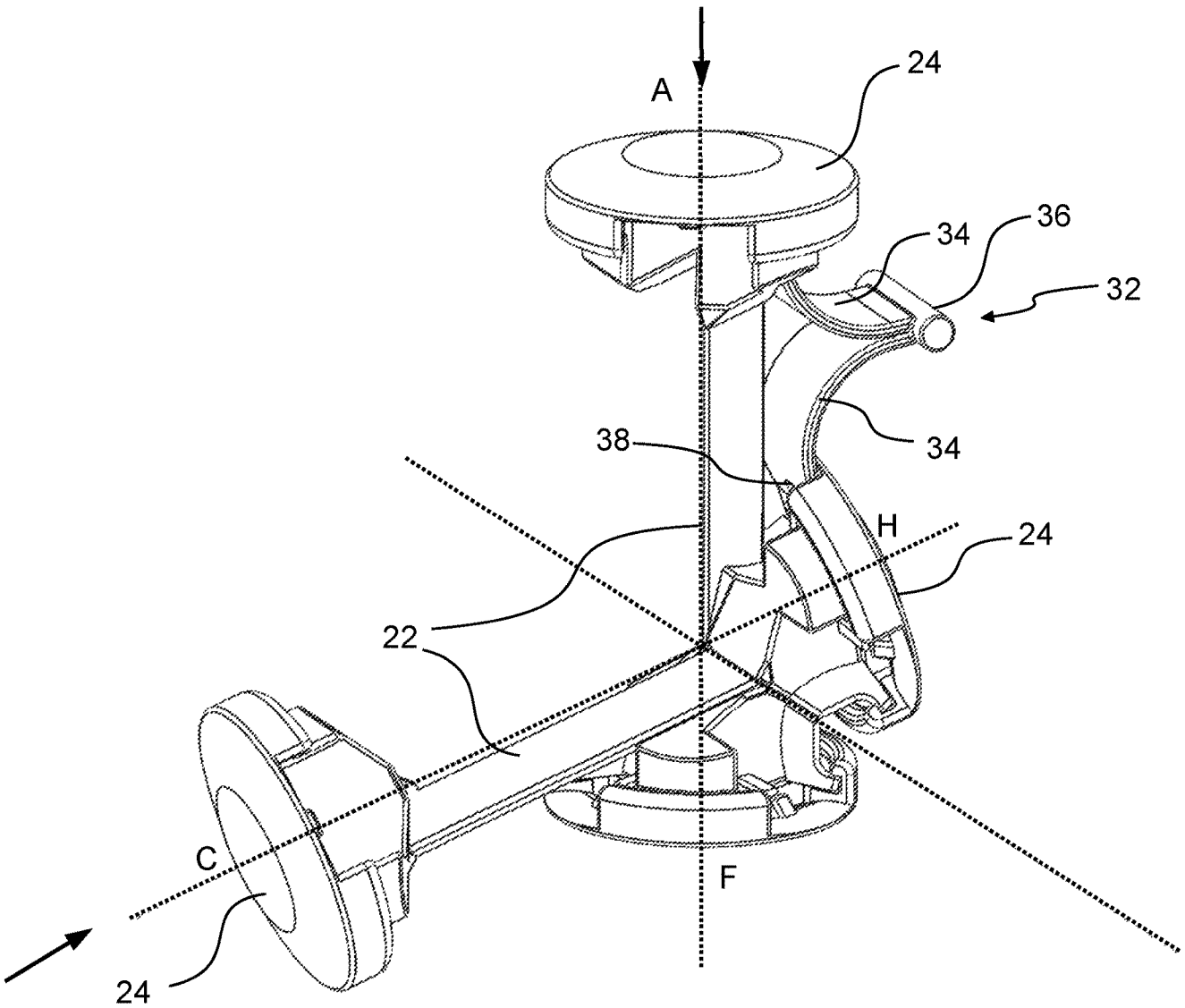
FIG. 9 is a perspective view of two pushing bars of the support structure of the 3-dimensional logic game according to FIG. 1 and of a two-armed actuating element of the actuating structure joining the two pushing bars in the first rest position.
Figure 10:
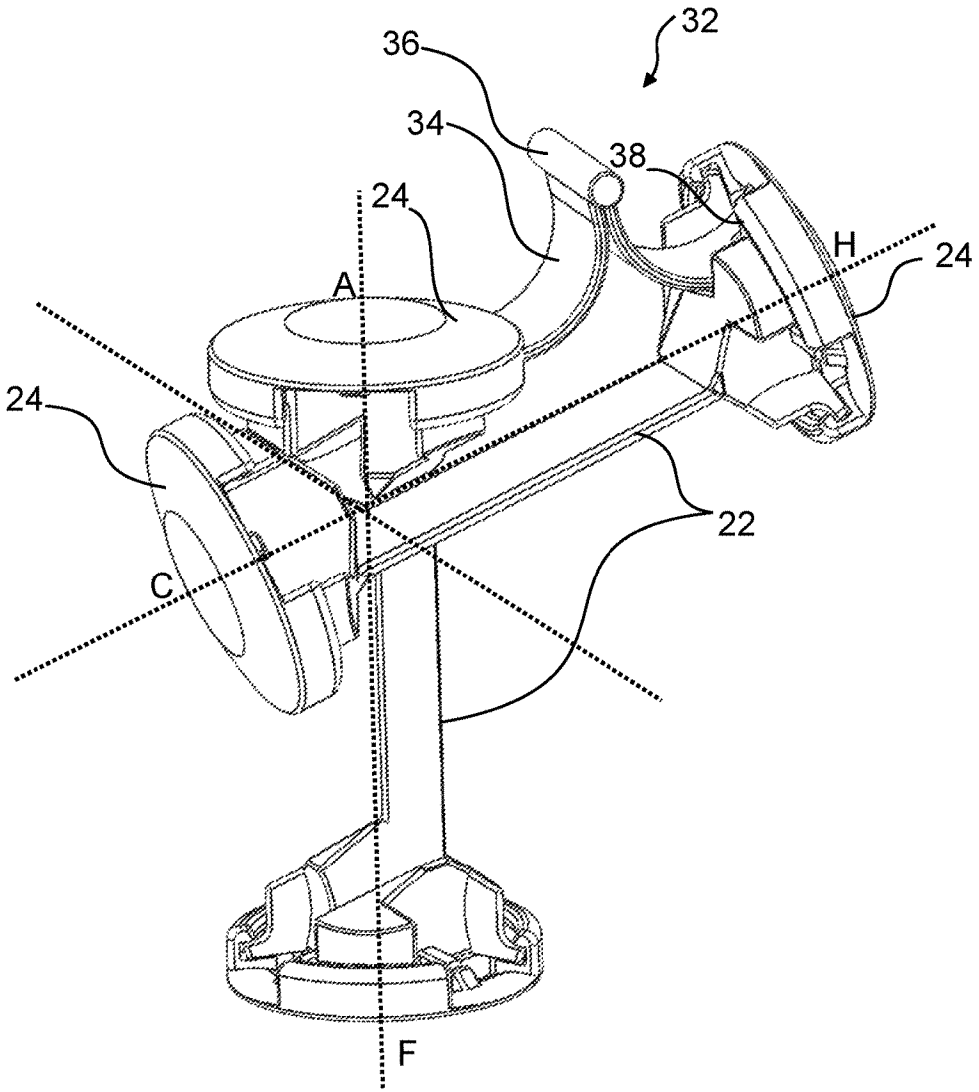
FIG. 10 is a perspective view of the two pushing bars and of the linking two-armed actuating element according to FIG. 9 in the second rest position.

FIG. 9 illustrates the location of two pushing bars 22 of the support structure 20 and that of the actuating element 32 of the actuating structure 30 connecting them in the first rest position of the actuating structure 30. In this position the pushing heads 24 at one end of each pushing bar 22 define the vertices A and C of the first tetrahedron 100. FIG. 10 depicts the same components in the second rest position wherein the pushing heads 24 at the other end of each pushing bar 22 define the vertices F and H of the second tetrahedron 200.

The user brings the 3-dimensional logic game 10 from the first rest position into the second rest position by pushing the pushing heads 24 (or some of the pushing heads 24) defining the vertices of the first tetrahedron 100 in an inward direction. According to the example illustrated in FIGS. 9-10 the user pushes the pushing heads 24 defining the vertices denoted by A and C in the direction of the arrows, i.e. inwardly along the medians 102 of the tetrahedron 100 in the direction of the geometric centre S of the tetrahedron 100, whereby the vertex 104 denoted by A approaches the geometric centre S, while the vertex 204 denoted by H moves away from the geometric centre S. During this motion the free ends 38 of the arms 34 of the actuating element 32 connecting the two pushing bars 22 come closer to each other which is allowed by the elastic deformation of the arms 34. The free ends 38 are closest to each other half way along the trajectory, i.e. when the two pushing bars 22 meet at their bisector point. Up until this position the user has to work against the counter force arising as a result of the elastic deformation of the arms 34 when pushing the pushing bars 22, from this position on the elastic force helps to move the pushing bars 22 to their second rest position by causing the free ends 38 to move away from each other which brings the pushing bars 22 into the second rest position illustrated in FIG. 10, wherein the free ends 38 are at the same maximal distance from each other as in FIG. 9. In the second rest position the pushing heads 24 defining the vertices 104 denoted by H and F are lying further away from the geometric centre S thus forming the second tetrahedron 200, while the vertices 104 denoted by A and C of the original first tetrahedron 100 have entered the interior of the second tetrahedron or have at least been moved closer to the geometric centre S.

Other embodiments are conceivable wherein the two arms 34 of the actuating element 32 are rigid, i.e. incapable of elastic deformation. In this case the linking element 36 may be a hinge around which the arms 34 may be rotated thus allowing the free ends 38 of the arms 34 to approach each other while the two connected pushing bars 22 are being displaced with respect to each other. It is also possible to ensure in this case that the actuating element 32 seeks to return to one of its rest positions when it is diverted from the rest position. For example. a spring may be arranged between the two arms 34, which is compressed while the pushing bars 22 are displaced whereby the arising spring force biases the arms 34 in the angle corresponding to the first and second rest position. It is also possible to carry out the invention without any constraining force being developed in the actuating element 32 as a result of the actuation, in this case, however, it is preferred to provide magnets 46 in the sides of the rails 40 which attract each other to thereby stabilise the rail rings 48, 48' belonging to the first and second rest position.

Figure 11:
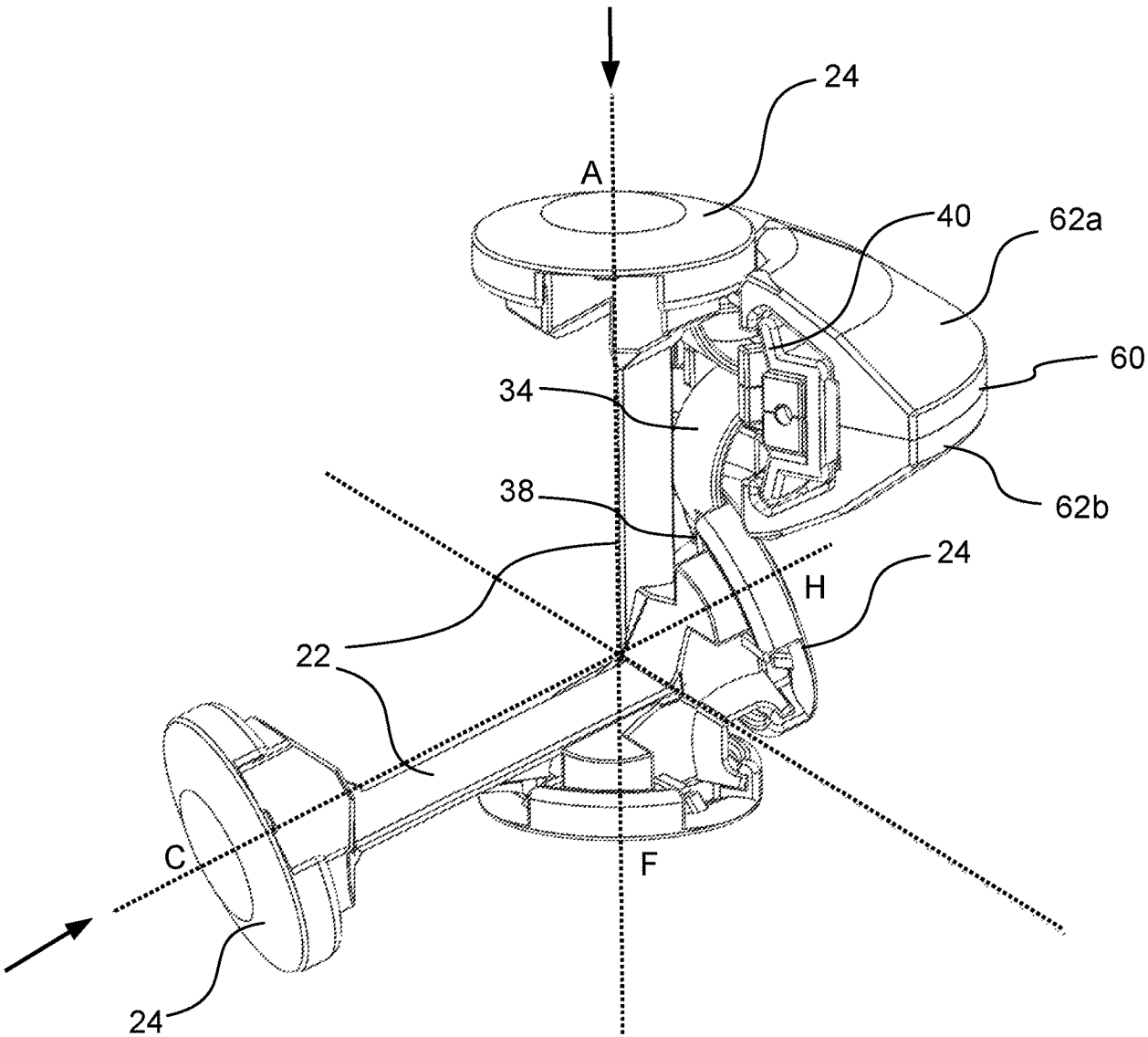
FIG. 11 is a perspective view showing the position of the rails and the carriages arranged thereon with respect to the two-armed actuating element according to FIG. 9 in the first rest position.
Figure 12:
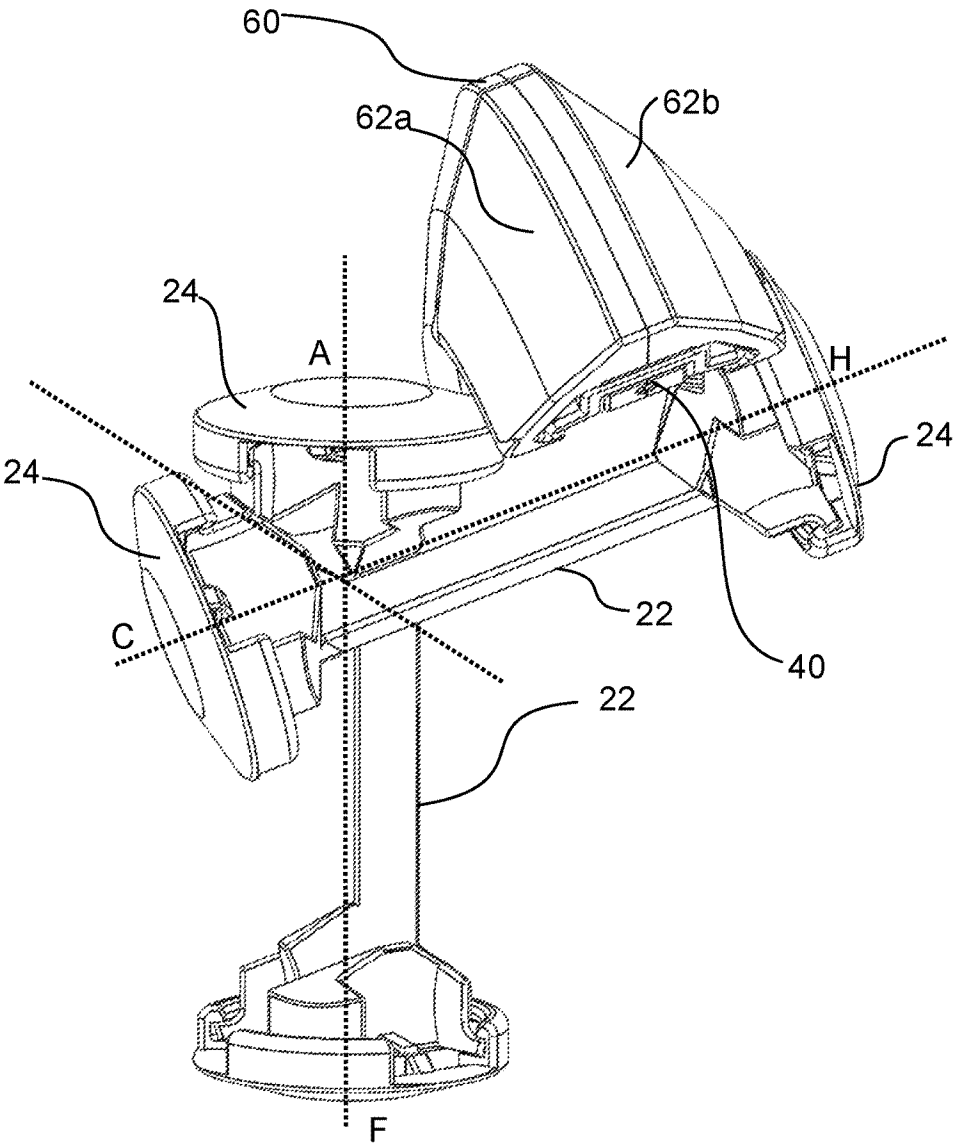
FIG. 12 is a perspective view showing the position of the rails and the carriages arranged thereon with respect to the two-armed actuating element according to FIG. 10 in the second rest position.

FIGS. 11 and 12 show the rail 40 connected to the linking element 36 of the actuating element 32 depicted in FIGS. 9 and 10 and the carriages 60—in the present case two carriages 60—arranged on the rail 40 in the first and second rest position of the actuating structure 30, respectively. It can be seen in FIG. 11 that in the first rest position the rail 40 forms a rail ring 48 around the vertex 104 denoted by A of the first tetrahedron 100 together with two other rails 40 (not shown here), while another rail 40 forms part of another rail ring 48 around the vertex 104 denoted by C. In this position the first marking surface **62*a* of the carriages 60 are facing outwardly, i.e. when the user turns the vertex 104 denoted by A or the vertex denoted by C in his or her direction the user sees the first marking surfaces 62*a*. In the second rest position illustrated in FIG. 12 the rail 40 around the vertex 104 denoted by A rotates together with the linking element 36 to the vertex H of the second tetrahedron 200 and forms a second rail ring 48' around it together with two other rails 40 which are not shown. The rail 40 which was earlier around the vertex 104 denoted by C rotates to the vertex 204 denoted by F of the second tetrahedron 200 and forms a second rail ring 48' around it. In this position the second marking surfaces 62*b* of the carriages 60 lie outside while the first marking surfaces 62*a* are partially covered by the carriages 60 located on the neighbouring rail rings 48' (see FIG. 7) According to the present embodiment the angle of rotation of the rails 40 and of the carriages 60 around their own axes is 109° 28' 16" (109 degrees, 28 minute of angle and 16 second of angle) which corresponds to the greater (obtuse) angle formed by the medians 102 of the first and the second tetrahedron 100, 200**.

In the first rest position of the actuating structure 30 the position of the supporting structure 20, the actuating structure 30 and the rails 40 is always the same with respect to each other, similarly, in the second rest position of the actuating structure 30 the relative position of the same elements is always the same (but different from the relative position belonging to the first rest position). In contradistinction the carriages 60 may assume a variety of positions in both rest positions; the number of variations of the states of the 3-dimensional logic game that the user can distinguish from each other depends on the differences between the markings provided on the marking surfaces **62*a* and 62*b*. According to a particularly preferred embodiment the game 10 has a first state in which the actuating structure 30 is in its first rest position and the markings on the outwardly facing first marking surfaces 62*a* of the carriages 60 located on each rail ring 48 around each vertex 104 of the first tetrahedron 100 is identical with each other but differs from the markings carried by the first marking surfaces 62*a* of the carriages 60 located on a different rail ring 48. Similarly, the game 10 has a second state (inverted state) in which the actuating structure 30 is in its second rest position and the markings on the outwardly facing second marking surfaces 62***b* of the carriages 60 located on each rail ring 48' around each vertex 204 of the second tetrahedron 200 is identical with each other but differs from the markings carried by the second marking surfaces 62*b* of the carriages 60 located on a different rail ring 48'. This means that the markings of a quarter of the first marking surfaces 62*a* are identical and the markings of a quarter of the second marking surfaces 62*b* are also identical.

According to a preferred embodiment the carriages 60 each comprise two halves 60*a*, 60*b* which are made of coloured material whereby the marking is the colour of the halves 60*a*, 60*b*. The halves 60*a* containing the first marking surfaces 62*a* have four different colours such that a quarter of the halves 60*a* have the same colour. The halves 60*b* containing the second marking surfaces 62*b* have four further different colours such that a quarter of the halves 60*b* have the same colour. Accordingly, if for example two carriages 60 are arranged on each rail 40 then there are 24 carriages 60, thus 24 first halves 60*a* and 24 second halves 60*b*. The first halves 60*a* contain 6-6-6-6 pieces of identical colour and the second halves 60*b* also contain 6-6-6-6 pieces of identical colour. It should be appreciated that from the point of view of playing this embodiment is equivalent to another embodiment of the game 10 where each carriage 60 is a unitary (single-piece) object and the first marking surfaces 62*a* are provided with 6-6-6-6 identical stickers, paintings or other markings while the second marking surfaces 62*b* are provided with 6-6-6-6 identical stickers, paintings or other markings The number of combinations of the possible states of the 10 game can be increased by arranging more carriages 60 on each rail 40 (for example by arranging three carriages 60 on each rail 40, whereby the game 10 contains altogether 36 carriages 60). A further possibility is to increase the number of different markings, for example in case of 24 carriages 60 every six surface having the same colour can be provided with a number between 1 and 6, whereby the basic challenge of getting all the marking surfaces 62*a*, 62*b* having the same colour markings on the same rail rings 48, 48' can be rendered more difficult if the user is also faced with the problem of arranging the numbers in order, for example in the solved state the marking surfaces 62*a* of the carriages 60 on one of the rail rings 48 should all contain red colour markings and the number markings of 1-6 should follow each other in increasing order along the given rail ring 48.

The pushing heads 24 may also be provided by different markings, for example each pushing head 24 can be provided with the same marking as that of one of the marking surfaces 62*a*, 62*b*, whereby it can be a further challenge to arrange the marking surfaces 62*a*, 62*b* along the rail ring 48, 48' surrounding the pushing head 24 provided with the same marking.

It should be appreciated that the number of combinations offered by the game 10 can also be decreased by decreasing the number of carriages 60 (arranging a single carriage 60 on each rail 40) and/or decreasing the diversity of the markings (for example both the first marking surfaces 62*a* and the second marking surfaces 62*b* contain two different kind of markings each). In this way the game 10 can be rendered more enjoyable for children and beginners.

Various modifications to the above disclosed embodiments will be apparent to a person skilled in the art without departing from the scope of protection determined by the attached claims.

The invention claimed is:

1. A 3-dimensional logic game comprising a support structure (20), an actuating structure (30) attached to the support structure (20) and game elements attached to the actuating structure (30), characterised by that the game elements are formed as carriages (60) provided with a first marking surface (62*a*) and a second marking surface (62*b*) and being slidably mounted on rails (40) attached to the actuating structure (30); the actuating structure (30) is movable between a first rest position and a second rest position, in the first rest position first groups of three rails (40) form first rail rings (48) around vertices (104) of a first tetrahedron (100) wherein first marking surfaces (62*a*) of the carriages (60) are facing outwardly, in a direction away from a geometric centre (S) of the first tetrahedron (100) while second marking surfaces (62*b*) of the carriages (60) are facing inwardly, and the first rail rings (48) allow for sliding the carriages (60) onto neighbouring rails (40); and in the second rest position of the actuating structure (30) second groups of three rails (40) form second rail rings (48') around vertices (204) of a second tetrahedron (200) being the point reflection of the first tetrahedron (100) reflected over the geometric centre (S) thereof, wherein any given rail (40) forms one of the second rail rings (48') around one of the vertices (204) of the second tetrahedron (200) together with two rails (40) that are positioned closest to the given rail (40) around neighbouring vertices (104) of the first tetrahedron (100) in the first rest position, and on the second rail rings (48') the second marking surfaces (62*b*) of the carriages (60) are facing outwardly, in a direction away from a geometric centre (S) of the second tetrahedron (200) while the first marking surfaces (62*a*) are facing inwardly, and the second ring rails (48') allow for sliding the carriages (60) onto neighbouring rails (40); the support structure (20) comprises pushing bars (22) having skew axis with respect to each other that are arranged along medians (102, 202) of the first and second tetrahedrons (100, 200), and the actuating structure (30) comprises double-armed actuating elements (32) the arms (34) of which are each attached to one of the pushing bars (22).

2. The 3-dimensional logic game according to claim 1, characterised by that each pushing bar (22) is provided with a pushing head (24) at each end thereof, and the arms (34) of the actuating elements (32) are joined together at one end by a linking element (36) to which one of the rails (40) is connected, and free ends (38) thereof are connected to a pair of neighbouring pushing bars (22) in vicinity of their respective pushing heads (24) that lie closer to each other.

3. The 3-dimensional logic game according to claim 2, characterised by that the pushing bars (22) and the actuating elements (32) are dimensioned such that:

in the first rest position of the actuating structure (30) a first pushing head (24) of a first pushing bar (22) out of the two neighbouring pushing bars (22) connected to the arms (34) of a given actuating element (32), which first pushing head (24) is closer to the given actuating element (32), is located at one of the vertices (104) of the first tetrahedron (100), the rail (40) which is connected to the linking element (36) of the given actuating element (32) constitutes one rail (40) in the first rail ring (48) formed around the same vertex (104), and a second pushing head (24) of a second pushing bar (22) out of the two neighbouring pushing bars (22) connected to the arms (34) of the given actuating element (32), which second pushing head (24) is closer to the given actuating element (32), is located closer to the geometric centre (S) of the first tetrahedron (100) than the first pushing head (24), such that the second pushing head (24) is inside the first tetrahedron (100), and in the second rest position of the actuating structure (30) the second pushing head (24) is located at one of the vertices (204) of the second tetrahedron (200), while the rail (40) which is connected to the linking element (36) of the given actuating element (32) constitutes one rail (40) in the second rail ring (48') formed around the same vortex (204) of the second tetrahedron (200), and the first pushing head (24) is located closer to the geometric centre (S) of the second tetrahedron (200) than the second pushing head (24), such that the first pushing head (24) is inside the second tetrahedron (200).

4. The 3-dimensional logic game according to claim 2, characterised by that the arms (34) of the actuating elements (32) are made of a resilient material allowing for flexion with respect to the linking element (36) linking them together by way of elastic deformation.

5. The 3-dimensional logic game according to claim 2, characterised by that the linking elements (36) of the actuating elements (32) each comprise a joint allowing for rotation of the two arms (34) linked together with respect to each other.

6. The 3-dimensional logic game according to claim 1, characterised by that at least two carriages (60) are arranged on each rail (40).

7. The 3-dimensional logic game according to claim 1, characterised by that the first and second marking surfaces (62*a*, 62*b*) of each carriage (60) carries a first and a second marking, respectively, that are different from each other, and the logic game has a first solved state in which the first markings on the outwardly facing marking surfaces (62*a*) of the carriages (60) on any given first rail ring (48) are the same with respect to each other and are different from the first markings on the outwardly facing marking surfaces (62*a*) of the carriages (60) on any other rail ring (48), and the logic game has a second solved state in which the second markings on the outwardly facing marking surfaces (62*b*) of the carriages (60) on any given second rail ring (48') are the same with respect to each other and are different from the second markings on the outwardly facing marking surfaces (62*b*) of the carriages (60) on any other second rail ring (48').

8. The 3-dimensional logic game according to claim 1, characterised by that pairs of magnets (46, 66) with opposed polarities and magnets (46, 66) and magnetisable elements are arranged on the rails (40) and on the carriages (60), respectively, for positioning the carriages (60).

9. The 3-dimensional logic game according to claim 1, characterised by that side magnets (46) are arranged at a side of a rail (40) with a polarity opposed to that of another side magnet (46) of a neighbouring rail (40).

10. The 3-dimensional logic game according to claim 1, characterised by that projections and indentations are formed at corresponding locations on the rails (40) and on the carriages (60), which together form snap connections, for positioning the carriages (60) with respect to the rails (40) and for positioning the rails (40) within the rail rings (48, 48').

11. The 3-dimensional logic game according to claim 1, characterised by that the marking surfaces (62*a*, 62*b*) of the carriages palpable markings.

12. The 3-dimensional logic game according to claim 11 wherein the palpable markings are embossed markings.

13. The 3-dimensional logic game according to claim 11 wherein the palpable markings are recessed markings.

14. The 3-dimensional logic game according to claim 1, characterised by that side magnets (46, 66) and magnetisable elements are arranged at neighbouring sides of rails (40) for positioning the rails (40) within rail rings (48, 48').

* * * * *